US008414107B2

(12) United States Patent
Kamiyama

(10) Patent No.: US 8,414,107 B2
(45) Date of Patent: Apr. 9, 2013

(54) LIQUID EJECTION DEVICE AND LIQUID EJECTION METHOD

(75) Inventor: Nobuaki Kamiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/217,756

(22) Filed: Aug. 25, 2011

(65) Prior Publication Data

US 2012/0062650 A1 Mar. 15, 2012

(30) Foreign Application Priority Data

Sep. 9, 2010 (JP) ..... 2010-202308

(51) Int. Cl.
*B41J 2/15* (2006.01)
*B41J 2/145* (2006.01)

(52) U.S. Cl.
USPC ..... 347/40; 347/90; 347/105

(58) Field of Classification Search ..... 347/34–36, 347/40, 42, 45, 47, 49, 65–72, 84–86, 89–90
See application file for complete search history.

(56) References Cited

U.S. PATENT DOCUMENTS 5,617,124 A * 4/1997 Taylor et al. ..... 347/35
6,007,177 A 12/1999 Takanaka et al.
6,293,641 B1 * 9/2001 Yoshimura et al. ..... 347/14

FOREIGN PATENT DOCUMENTS

JP 08-150722 A 6/1996

* cited by examiner

*Primary Examiner* — Thinh Nguyen
(74) *Attorney, Agent, or Firm* — Global IP Counselors, LLP

(57) ABSTRACT

The liquid ejection device includes a head having nozzles for ejecting a liquid, a first liquid-receiving section having a sloped face for receiving liquid ejected from the nozzles when flushing is carried out by the head, and a second liquid-receiving section for receiving and holding liquid that has dripped from the sloped face. The liquid ejected from the nozzles through flushing can flow away, and therefore printing defects caused by accumulation of the liquid can be prevented.

6 Claims, 5 Drawing Sheets

LIQUID EJECTION DEVICE AND LIQUID EJECTION METHOD

CROSS-REFERENCE TO RELATED APPLICATIONS

This application claims priority to Japanese Patent Application No. 2010-202308 filed on Sep. 9, 2010. The entire disclosure of Japanese Patent Application No. 2010-202308 is hereby incorporated herein by reference.

BACKGROUND

1. Technical Field

The present invention relates to a liquid ejection device and a liquid ejection method.

2. Related Art

Liquid ejection devices that carry out maintenance referred to as flushing, which involves forcible continuous ejection of ink drops from nozzles in order to eliminate foreign substances or the like adhering to a nozzle face, are known in the prior art (for example, Japanese Laid-Open Patent Application No. 8-150722).

SUMMARY

When flushing is carried out in such a liquid ejection device, ink that has been ejected toward a flushing box is absorbed into an absorbent material disposed inside the flushing box.

In cases where the ink that has been absorbed into the absorbent material has poor re-dissolvability or re-dispersibility, once the ink dries, the voids of the absorbent material become filled with dried ink, and therefore the absorbent material can no longer absorb ink. For this reason, the ink ejected toward the flushing box accumulates on the absorbent material without being absorbed therein. In some cases, such accumulations of ink cause printing defects.

With the foregoing in view, it is an object of the present invention to prevent printing defects caused by accumulation of a liquid that has been ejected from nozzles through flushing.

In order to address the aforementioned problem, a liquid ejection device according to one aspect of the present invention includes a head, a first liquid-receiving section and a second liquid-receiving section. The head has a plurality of nozzles configured and arranged to eject a liquid. The first liquid-receiving section has a sloped face for receiving a liquid ejected from the nozzles when flushing is carried out by the head. The second liquid-receiving section is configured and arranged to receive and hold liquid that has dripped from the sloped face.

These and other features of the present invention will be apparent from the disclosure of the present Specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
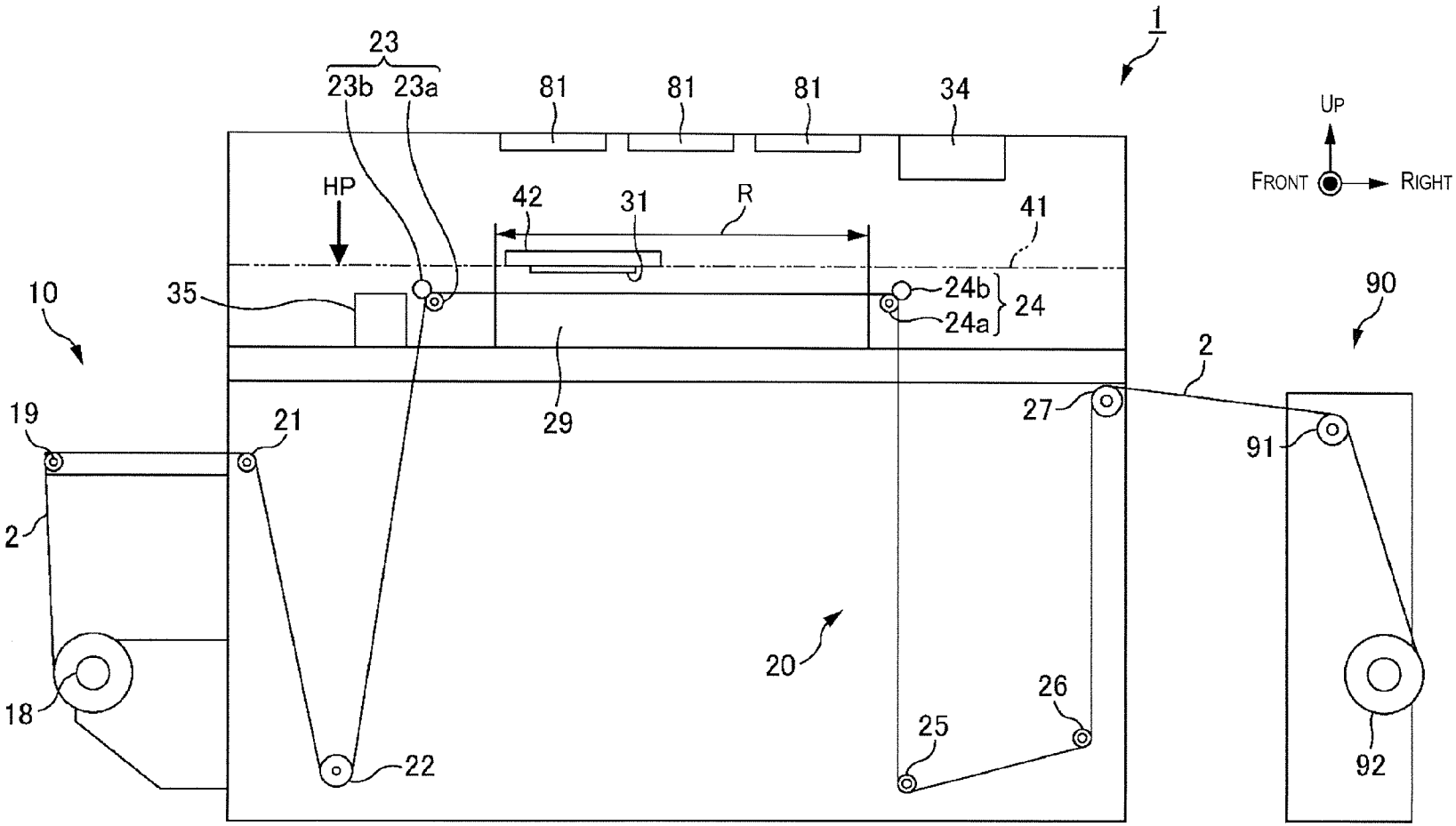
FIG. 1 is a simplified diagram depicting the configuration of a liquid ejection device 1.

The following will be apparent from the matters set forth in the present specification and the accompanying drawings.

Namely, a liquid ejection device includes a head, a first liquid-receiving section and a second liquid-receiving section. The head has a plurality of nozzles configured and arranged to eject a liquid. The first liquid-receiving section has a sloped face for receiving a liquid ejected from the nozzles when flushing is carried out by the head. The second liquid-receiving section is configured and arranged to receive and hold liquid that has dripped from the sloped face.

According to this liquid ejection device, the liquid that has been ejected from the nozzles due to flushing can flow away, and therefore printing defects caused by accumulation of the liquid can be prevented.

In the liquid ejection device, the first liquid-receiving section preferably has a cylindrical shape, and configured and arranged to receive the liquid ejected downward from the nozzles on a curving face of the cylindrical shape, which constitutes the sloped face.

According to this liquid ejection device, the liquid ejected downward from the nozzles due to flushing can easily flow.

In the liquid ejection device, the head preferably has a plurality of nozzle rows lined up in a direction orthogonal to a cylinder axis direction of the first liquid-receiving section, the nozzle rows being formed by lining up the nozzles along the cylinder axis direction, and when flushing of one of the nozzle rows is carried out, the head is preferably configured and arranged to eject the liquid downward from the nozzles of the one of the nozzle rows with the one of the nozzle rows being at a position at which a distance from the nozzles that form the one of the nozzle rows to the cylinder axis of the first liquid-receiving section is the shortest.

According to this liquid ejection device, because the distance for which the liquid ejected downward from the nozzles descends is the shortest one, misting (i.e., assuming the form of a mist) of the liquid can be reduced.

Also, in the liquid ejection device, the head preferably has a plurality of nozzle rows lined up in a direction orthogonal to the cylinder axis direction of the first liquid-receiving section, the nozzle rows being formed by lining up the nozzles along the cylinder axis direction, and when flushing of one of the nozzle rows is carried out, the head is preferably configured and arranged to eject the liquid downward from the nozzles of the one of the nozzle rows with the one of the nozzle rows being at a position that is offset in the direction orthogonal to the cylinder axis direction from a position at which a distance from the nozzles that form the one of the nozzle rows to the cylinder axis of the first liquid-receiving section is the shortest.

According to this liquid ejection device, the liquid ejected downward from the nozzles due to flushing can flow more easily.

Also, the liquid ejection device may further includes a conveying section configured and arranged to convey a medium along a conveyance path, and a blower disposed above a printing region on the conveyance path, and configured and arranged to blow air onto the medium on the conveyance path. The head is preferably configured and arranged to eject the liquid downward from the nozzles of the one of the nozzle rows at a position that is offset in a direction away from the blower in the direction orthogonal to the cylinder axis direction from the position at which the distance from the nozzles that form the one of the nozzle rows to the cylinder axis of the first liquid-receiving section is the shortest.

According to this liquid ejection device, drying out of the liquid ejected downward from the nozzles due to flushing can be prevented, and the liquid can flow more easily.

Also, in the liquid ejection device, at least a part of the sloped face of the first liquid-receiving section preferably has an outer layer section of a substance having hydrophilicity.

According to this liquid ejection device, the liquid ejected downward from the nozzles due to flushing can be kept from spreading out over the entire sloped face, and therefore drying out of the liquid can be prevented, and the liquid can flow more easily.

A liquid ejection method is a method for a liquid ejection device including a head having a plurality of nozzles configured and arranged to eject a liquid, a first liquid-receiving section having a sloped face for receiving a liquid ejected from the nozzles when flushing is carried out by the head, and a second liquid-receiving section configured and arranged to receive and hold liquid that has dripped from the sloped face. The liquid ejection method includes ejecting the liquid from the nozzles to the sloped face of the first liquid-receiving section to carry out the flushing so that the liquid that has dripped from the sloped face is received and held in the second liquid-receiving section.

According to this liquid ejection method, printing defects caused by accumulation of the liquid ejected from the nozzles by flushing can be prevented.

EMBODIMENT

A liquid ejection device 1 according to an embodiment of the present invention is described below.

Configuration Example of Liquid Ejection Device 1

Figure 2:
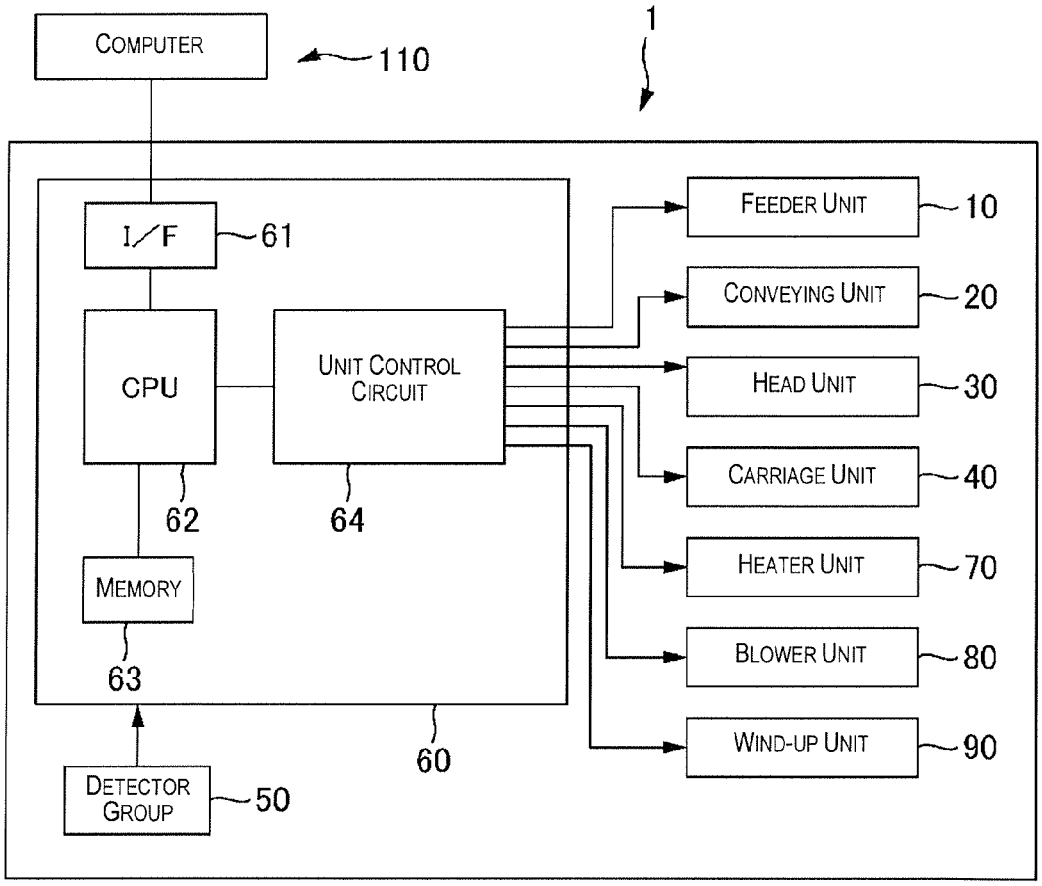
FIG. 2 is a block diagram depicting the configuration of the liquid ejection device 1.

A configuration example of the liquid ejection device 1 is described using FIG. 1 and FIG. 2. FIG. 1 is a simplified sectional diagram of the liquid ejection device 1. FIG. 2 is a block diagram of the liquid ejection device 1.

In the following description, cases where the terms "vertical direction" and "lateral direction" are used depict orientation in directions shown by arrows in FIG. 1 as a reference. Cases where the term "longitudinal direction" is used depict orientation in a direction orthogonal to the plane of page in FIG. 1.

In the present embodiment, the liquid ejection device 1 is described using roll-fed paper (continuous length paper) as the medium for recording images.

As depicted in FIG. 1 and FIG. 2, the liquid ejection device 1 according to the present embodiment has a conveying unit 20 as an example of the conveying section; a feeder unit 10 on a conveyance path along which roll-fed paper 2 is conveyed by the conveying unit 20; a platen 29 as an example of a medium supporting section; and a wind-up unit 90; and further has a head unit 30 for carrying out printing in a printing region R on the conveyance path; a carriage unit 40 as an example of a head traveling section; a heater unit 70 as an example of a heat-supplying section; a blower unit 80 for blowing air onto the roll-fed paper 2 on the platen 29; a controller 60 for controlling these units and for managing the operations of the liquid ejection device 1; and a detector group 50.

The feeder unit 10 feeds the roll-fed paper 2 to the conveying unit 20. This feeder unit 10 has a rotatably supported winder shaft 18 onto which the roll-fed paper 2 is wound; and a relay roller 19 about which the roll-fed paper 2 that has been delivered from the winder shaft 18 is wound and directed into the conveying unit 20.

The conveying unit 20 conveys along a preset conveyance path the roll-fed paper 2 that has been advanced by the feeder unit 10. As depicted in FIG. 1, this conveying unit 20 has a relay roller 21 positioned horizontally to the right with respect to the relay roller 19; a relay roller 22 positioned to the right and diagonally downward as seen from the relay roller 21; first conveying rollers 23 positioned to the right and diagonally upward as seen from the relay roller 22 (to the upstream end in the conveyance direction as seen from the platen 29); second conveying rollers 24 positioned to the right as seen from the first conveying rollers 23 (to the downstream end in the conveyance direction as seen from the platen 29); a reversing roller 25 positioned plumb vertically downward as seen from the second conveying rollers 24; a relay roller 26 positioned to the right as seen from the reversing roller 25; and an outfeed roller 27 positioned upward as seen from the relay roller 26.

The relay roller 21 is a roller about which the roll-fed paper 2 advancing from the relay roller 19 is wound from the left side and directed downward while being slackened.

The relay roller 22 is a roller about which the roll-fed paper 2 advancing from the relay roller 21 is wound from the left side and conveyed to the right and diagonally upward.

The first conveying rollers 23 have a first drive roller 23*a* driven by a motor, not shown; and a first follower roller 23*b* disposed in opposition to the first drive roller 23*a*, with the roll-fed paper 2 sandwiched therebetween. These first conveying rollers 23 are rollers adapted to draw upward the downwardly slackened roll-fed paper 2 and to convey the paper to the printing region R in opposition to the platen 29. During intervals in which image printing is taking place on an area of the roll-fed paper 2 in the printing region R, the first conveying rollers 23 temporarily halt conveying. Through drive control by the controller 60, the conveyance amount (length of an area of the roll-fed paper) of the roll-fed paper 2 positioned on the platen 29 is adjusted through rotation of the first follower roller 23*b* in association with the driving rotation of the first drive roller 23*a*.

As mentioned previously, the conveying unit 20 has a mechanism adapted to convey the roll-fed paper 2 while slackening to the downward end an area thereof that has been wound about between the relay rollers 21, 22 and the first conveying rollers 23. This slack produced in the roll-fed paper 2 is monitored by the controller 60 on the basis of a detection signal from a slack detection sensor, not shown. Specifically, in a case where the slack detection sensor detects the slackened area of the roll-fed paper 2 between the relay rollers 21, 22 and the first conveying rollers 23, because tension of appropriate magnitude is being imparted to the area in question, it is possible for the conveying unit 20 to convey the roll-fed paper 2 in a slackened state. On the other hand, in a case where the slack detection sensor does not detect the slackened area of the roll-fed paper 2, because tension of excessive magnitude is being imparted to the area in question, the conveying unit 20 temporarily halts conveying of the roll-fed paper 2 to adjust the tension to the appropriate magnitude.

The second conveying rollers 24 have a second drive roller 24*a* driven by a motor, not shown; and a second follower roller 24*b* disposed in opposition to the second drive roller 24*a*, with the roll-fed paper 2 sandwiched therebetween.

These second conveying rollers 24 are rollers that, after an image has been recorded onto an area of the roll-fed paper 2 by the head unit 30, convey this area to the horizontal right direction along the support face of the platen 29, and subsequently convey the area downward in the plumb vertical direction. In so doing, the conveyance direction of the roll-fed paper 2 is converted. Through rotation of the second follower roller 24*b* in association with driving rotation of the second drive roller 24*a* by drive control of the controller 60, adjustments are made to a predetermined tension which is imparted to the area of the roll-fed paper 2 positioned over the platen 29.

The reversing roller 25 is a roller that conveys the roll-fed paper 2 advancing from the second conveying rollers 24 and winds the paper to the right and diagonally upward from the upper left side.

The relay roller 26 is a roller that conveys the roll-fed paper 2 advancing from the reversing roller 25, and winds the paper upward from the lower left side.

The outfeed roller 27 winds the roll-fed paper 2 advancing from the relay roller 26, and feeds the paper out to the wind-up unit 90 from the lower left side.

Through serial traveling of the roll-fed paper 2 through the rollers in this way, there is formed a conveyance path for the purpose of conveying the roll-fed paper 2. The roll-fed paper 2 is conveyed along this conveyance path in intermittent fashion by the conveying unit 20, in unit regions that correspond to the printing region R.

The purpose of the head unit 30 is to eject ink onto an area of the roll-fed paper 2 fed into the printing region R (over the platen 29) on the conveyance path by the conveying unit 20. This head unit 30 has a head 31 and a valve unit 34.

The head 31 has on the bottom face thereof nozzle rows which are respectively composed of a plurality of nozzles #1 to #180 for each of a number of colors such as yellow (Y), magenta (M), cyan (C), and black (K). During flushing, the head 31 carries out flushing of every nozzle row.

The nozzles #1 to #180 of the nozzle rows align in linear fashion along a direction intersecting the conveyance direction of the roll-fed paper 2. The nozzle rows are disposed parallel along the travel direction of the head 31 (the main scanning direction), with spaces between them. The nozzles #1 to #180 are provided with piezo elements (not shown) as drive elements for the purpose of ejecting ink drops. When a voltage of a predetermined duration is applied across electrodes provided at both ends, the piezo elements stretch in accordance with the duration of the application of voltage, causing the side walls of the ink channels to deform. Because of this, the volume of the ink channels constricts in accordance with expansion and contraction of the piezo elements, and amounts of ink commensurate with this constriction are ejected as ink drops from the nozzles #1 to #180 of the different colors.

The purpose of the valve unit 34 is to temporarily hold ink, and the unit is connected to the head 31 via an ink supply tube, not shown. The head 31 can therefore print an image by causing the ink supplied from the valve unit 34 to be ejected from the nozzles toward an area of the roll-fed paper 2 conveyed to and halted over the platen 29.

The purpose of the carriage unit 40 is to cause the head 31 to travel. This carriage unit 40 has a guide rail 41 (depicted by double-dot and dash lines in FIG. 1) extending in the lateral direction; a carriage 42 supported in a reciprocating travelable manner in the lateral direction (travel direction) along the guide rail 41; and a motor, not shown.

The carriage 42 is configured to travel in a unitary manner with the head 31 by driving of the motor, not shown. The position (position in the lateral direction) of the carriage 42 (the head 31 or the nozzle rows) on the guide rail 41 can be derived by the controller 60 detecting the rising edge and the falling edge in a pulse signal output from an encoder provided to the motor, not shown, and counting these edges.

When cleaning of the head 31 is carried out after printing of an image, the carriage 42 travels in a unitary manner with the head 31 along the guide rail 41 toward the upstream end in the conveyance direction (the upstream end in the conveyance direction as seen from the platen 29), and halts at a home position HP where cleaning is carried out (see FIG. 1).

A cleaning unit, not shown, is provided at the home position HP. This cleaning unit has a cap, a suction pump, and the like. With the carriage 42 positioned at the home position HP, the cap, not shown, comes into intimate contact against the bottom face (nozzle face) of the head 31. When the suction pump (not shown) is operated with the cap in a state of intimate contact in this way, ink inside the head 31 is suctioned out together with thickened ink and paper dust. Cleaning of the head is completed by recovery of clogged nozzles from a non-ejecting state in this way.

When flushing of the head 31 is carried out after printing of an image, the carriage 42 travels in a unitary manner with the head 31 from the platen 29 toward the home position HP. During this time, while traveling together with the carriage 42, the head 31 carries out a flushing operation in a flushing unit 35 which is disposed between the platen 29 and the home position HP. The flushing unit 35 and the flushing operation are discussed in detail later.

The platen 29 supports an area of the roll-fed paper 2 positioned in the printing region R on the conveyance path, and heats the area in question. As depicted in FIG. 1, this platen 29 is provided in correspondence with the printing region R on the conveyance path, and is disposed in a region along the conveyance path between the first conveying rollers 23 and the second conveying rollers 24. Then, by being supplied with heat generated by the heater unit 70, the platen 29 can heat the area in question of the roll-fed paper 2.

The purpose of the heater unit 70 is to heat the roll-fed paper 2, and the unit has a heater, not shown. This heater has a nichrome wire and is configured by disposing the nichrome wire in the interior of the platen 29 in such a way that the wire is given a fixed distance from the support surface of the platen 29. Because of this, through energizing of the heater the nichrome wire itself is caused to emit heat, and the heat can be conducted to the area of the roll-fed paper 2 positioned on the support face of the platen 29. Because the heater is configured by embedding the nichrome wire throughout the entire platen 29, heat can be evenly conducted to the area of the roll-fed paper 2 on the platen 29. In the present embodiment, the area of the roll-fed paper 2 on the platen is evenly heated such that the temperature of the area of the roll-fed paper 2 in question reaches 45° C. In so doing, the ink that has landed in the area of the roll-fed paper 2 in question can be caused to dry.

The blower unit 80 is provided with fans 81 as an example of the blower, and with a motor (not shown) for rotating the fans 81. By rotation of the fans 81, air is blown onto the roll-fed paper 2 on the platen 29, causing the ink that has landed on the roll-fed paper 2 to dry. As depicted in FIG. 1, a plurality of the fans 81 are furnished within a reclosable cover (not shown) which is furnished to the chassis section. With the cover closed, each of these individual fans 81 is positioned above the platen 29 so as to lie in opposition to the support face of the platen 29 (the roll-fed paper 2 on the platen 29).

The purpose of the wind-up unit 90 is to wind up the roll-fed paper 2 (roll-fed paper on which an image has finished printing) being advanced by the conveying unit 20. This wind-up unit 90 has a relay roller 91 about which the roll-fed paper 2 advancing from the outfeed roller 27 is wound from the left side upward and conveyed towards the right and diagonally downward; and a wind-up drive shaft 92 for winding up the roll-fed paper 2 advancing from the rotatably supported relay roller 91.

The controller 60 is a control unit for carrying out control of the liquid ejection device 1. As depicted in FIG. 2, this controller 60 has an interface section 61, a CPU 62, a memory 63, and a unit control circuit 64. The purpose of the interface section 61 is to send and receive data between the liquid ejection device 1 and a host computer 110, which is an external device. The CPU 62 is a processing device for carrying out control of the entire liquid ejection device 1. The purpose of the memory 63 is to ensure a region for the CPU 62 to store programs, a work region, and the like. The CPU 62 controls the units by the unit control circuit 64 in accordance with a program saved in the memory 63.

The detector group 50, the purpose of which is to monitor the conditions inside the liquid ejection device 1, is, for example, a rotary encoder attached to a conveying roller and utilized to control conveying of the medium or the like, a paper detection sensor for detecting the presence of a medium being conveyed, a linear encoder for detecting the position of the carriage 42 (or the head 31) in the travel direction (lateral direction), or the like.

Flushing Unit 35

Figure 3A:
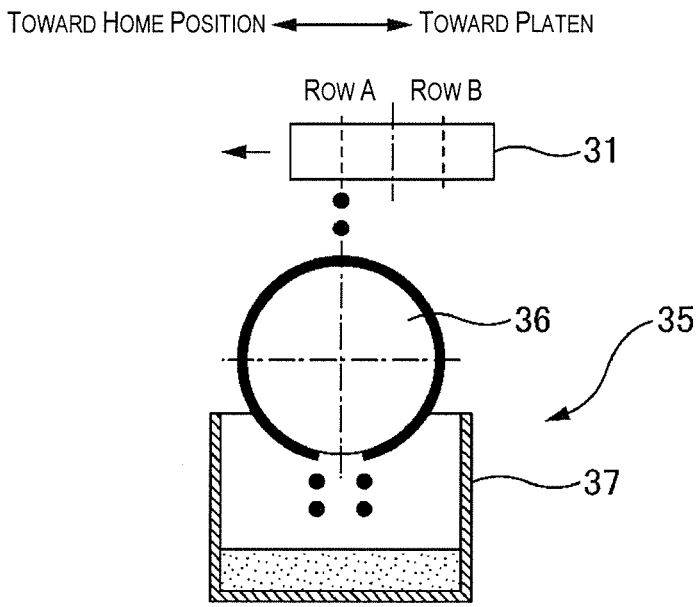
FIGS. 3A and 3B are diagrams describing an example of a flushing operation.
Figure 3B:
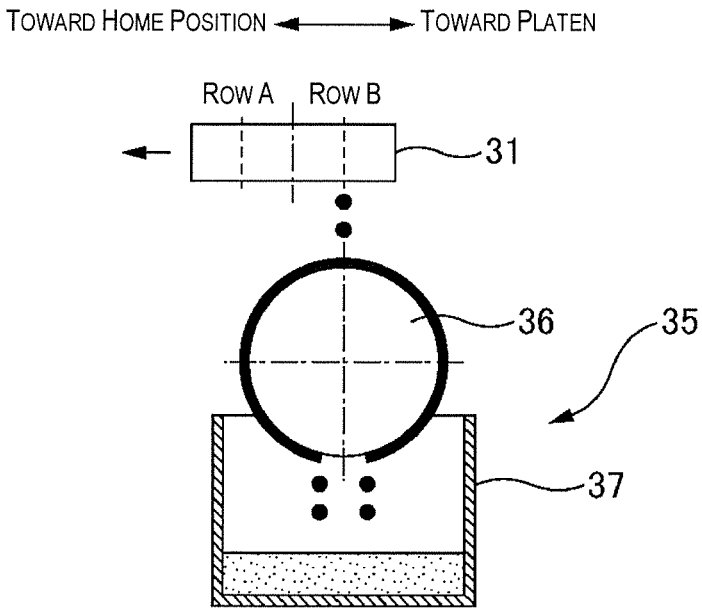

Here, the flushing unit 35 is described using FIG. 1, FIGS. 3A and 3B. FIGS. 3A and 3B are diagrams depicting a schematic example of the flushing unit 35.

In the liquid ejection device 1 according to the present embodiment, flushing is carried out in the flushing unit 35.

Flushing is a maintenance process for nozzle recovery, and is intended to prevent loss of ability to eject correct amounts of ink due to nozzles becoming clogged by thickening of the ink in proximity to the nozzles, or to air bubbles becoming entrained inside nozzles. Specifically, it is an operation whereby a drive signal having no relation to an image for printing is applied to the drive elements (piezo elements) to forcibly eject ink therefrom. Whereas at times of normal printing, ink is ejected from nozzles selected on the basis of image data, during flushing, ink is ejected with no relation to printing, and therefore a large quantity of liquid is ejected toward the flushing unit 35 from a multitude of nozzles (all of the nozzles, or nozzles experiencing ejection defects). Because of this, flushing creates a state in which ink mist is most likely to be produced.

In conventional liquid ejection devices, the ink ejected toward the flushing box by the head when flushing is carried out is absorbed by an absorbent material disposed inside the flushing box. In so doing, soiling of the nozzle face (nozzle plate) or of the medium due to ink mist produced during flushing can be prevented.

However, in cases where the ink that has been absorbed into the absorbent material has poor re-dissolvability or re-dispersibility, once the ink dries, the voids of the absorbent material become filled with dried ink, and therefore the absorbent material can no longer absorb ink. For this reason, the ink ejected toward the flushing box accumulates on the absorbent material without being absorbed therein.

Once ink accumulates on the absorbent material in this way, in some cases the accumulated ink may contact the nozzle face (nozzle plate), and soil or obstruct the nozzles. Because of this, there is a risk that printing defects such as missing dots or the like may occur.

By contrast, with the liquid ejection device 1 according to the present embodiment, rather than having the ink ejected from the nozzles during flushing be received and absorbed by an absorbent material, by instead using a flushing unit 35 having a first liquid-receiving section that receives the ink on a sloped face, the ink may flow away without being absorbed. In this way, by discharging the ink ejected from the nozzles by flushing, printing defects due to accumulation of the ink can be prevented.

Specifically, as depicted in FIGS. 3A and 3B, the flushing unit 35 has a cylindrical pipe 36 as an example of the first liquid-receiving section, and a flushing box 37 as an example of the second liquid-receiving section. As depicted in FIG. 1, this flushing unit 35 is then furnished at the upstream end in the conveyance direction as viewed from the platen 29.

The cylindrical pipe 36 is formed to a cylindrical shape, and ink drops ejected from nozzles during flushing are received on a curved face thereof, which is the sloped face. Because the first liquid-receiving section in the present embodiment is the cylindrical pipe 36 formed to a cylindrical shape, ink ejected downward from nozzles during flushing can easily drip off. Moreover, the spaced needed to accommodate the components can be minimal.

The flushing box 37 receives and holds ink drops that, after landing on the curved face of the cylindrical pipe 36, have flowed away downward along the curved face and dripped from the cylindrical pipe 36.

First Example of Operation During Flushing

Next, a first example of operation during flushing is described using FIGS. 3A and 3B. FIGS. 3A and 3B are diagrams describing an example of a flushing operation. In the first example of operation, for convenience, the flushing operation is described using a head 31 having on its bottom face two nozzle rows (row A, row B) formed by a plurality of nozzles that are lined up along the cylinder axis direction of the cylindrical pipe 36, the two nozzle rows (row A, row B) being lined up in a direction orthogonal to the cylinder axis direction.

The various operations of the liquid ejection device 1 are accomplished primarily by the controller 60. In particular, in the present embodiment, a program stored in the memory 63 is executed through processing by the CPU 62. This program is composed of code for carrying out various operations described below.

When a control signal of a flushing operation from the host computer 110 is input to the controller 60 via the interface section 61, by control of the unit control circuit 64, the carriage 42 currently positioned in the printing region R travels along the guide rail 41 from the platen 29 to the home position HP. Because this carriage 42 travels in a unitary manner with the head 31, the head 31 also travels from the platen 29 to the home position HP. Then, by control of the unit control circuit 64, the head 31 repeatedly carries out a flushing operation for each nozzle row while traveling in the flushing unit 35 disposed between the platen 29 and the home position HP.

Specifically, first, as depicted in FIG. 3A, the traveling head 31 carries out flushing for the nozzle row of row A, at a position of the shortest linear distance down to the cylinder axis of the cylindrical pipe 36 from the nozzles that form row A. Namely, at the position in question, the head 31 forcibly ejects ink downward from the nozzles that form row A. Thereupon, the ink drops ejected from the nozzles land on the curved face, which is the sloped face of the cylindrical pipe 36, and thereafter proceed to flow away downward along the curved face, ultimately dripping off from the cylindrical pipe 36. The dripped ink drops are received by the flushing box 37 and held inside.

Next, as depicted in FIG. 3B, the head 31, which is continuing to travel, now carries out flushing for the nozzle row of row B, at a position of the shortest linear distance down to the cylinder axis of the cylindrical pipe 36 from the nozzles that form row B. Namely, at the position in question, the head 31 forcibly ejects ink downward from the nozzles that form row B. Thereupon, the ink drops ejected from the nozzles land on the curved face, which is the sloped face of the cylindrical pipe 36, and thereafter proceed to flow away downward along the curved face, ultimately dripping off from the cylindrical pipe 36. The dripped ink drops are received by the flushing box 37 and held inside.

In this way, with the liquid ejection device 1 in the present embodiment, for either nozzle row, flushing takes place when the linear distance in question is shortest, whereby the gap between the nozzle face and the cylindrical pipe 36 is small, and misting of the ink ejected from the nozzles can be reduced.

Meanwhile, in cases where the amount of ink that lands on the curved face of the cylindrical pipe 36 is small, the ink dries before it can flow and becomes deposited on the curved face, and the ink that has landed on the curved face can no longer flow away downward. In contrast to this, with the liquid ejection device in the present embodiment, when flushing of every nozzle row is carried out, flushing takes place at the same area of the cylindrical pipe 36 for either nozzle row, and therefore even in cases where the amount of ink ejected onto the area in question from every nozzle row is small, adding up the amounts of ink for all of the nozzle rows increases the amount of ink that lands on the area in question. Because of this, ink that lands on the curved face of the cylindrical pipe 36 can easily flow away downward without drying.

Second Example of Operation During Flushing

Figure 4A:
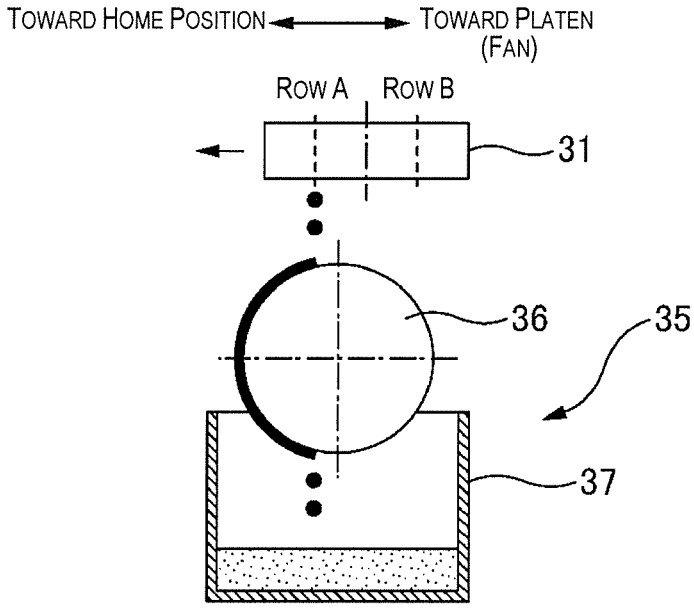
FIGS. 4A and 4B are diagrams describing another example of a flushing operation.
Figure 4B:
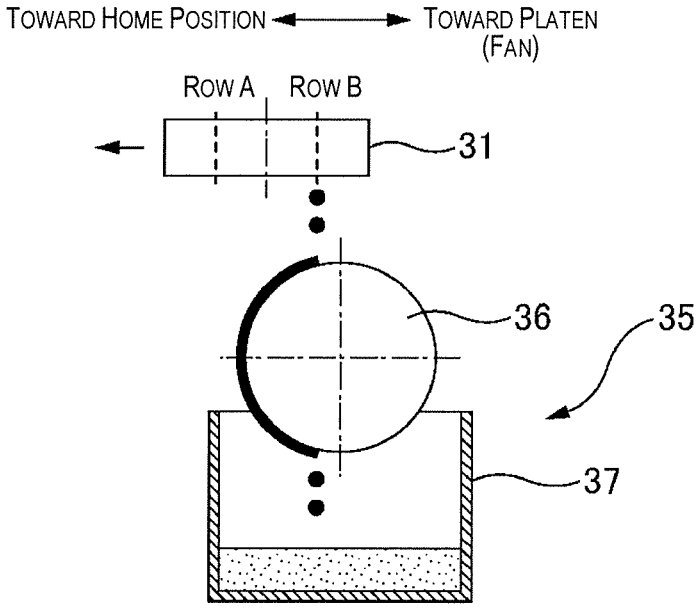

Next, a second example of operation during flushing is described using FIGS. 4A and 4B. FIGS. 4A and 4B are diagrams describing an example of a flushing operation. In the second example of operation, as in the first operation example, for convenience, the flushing operation is described using the head 31 having on its bottom face two nozzle rows (row A, row B) formed by a plurality of nozzles that are lined up along the cylinder axis direction of the cylindrical pipe 36, the two nozzle rows (row A, row B) being lined up in a direction orthogonal to the cylinder axis direction.

The various operations of the liquid ejection device 1 are accomplished primarily by the controller 60. In particular, in the present embodiment, a program stored in the memory 63 is executed through processing by the CPU 62. This program is composed of code for carrying out various operations described below.

When a control signal of a flushing operation from the host computer 110 is input to the controller 60 via the interface section 61, by control of the unit control circuit 64, the carriage 42 currently positioned in the printing region R now travels along the guide rail 41 from the platen 29 to the home position HP. Because this carriage 42 travels in a unitary manner with the head 31, the head 31 also travels from the platen 29 to the home position HP. Then, by control of the unit control circuit 64, the head 31 repeatedly carries out a flushing operation for each nozzle row, while traveling in the flushing unit 35 disposed between the platen 29 and the home position HP.

Specifically, first, as depicted in FIG. 4A, the traveling head 31 carries out flushing for the nozzle row of row A, at a position that is offset in a direction orthogonal to the cylinder axis direction of the cylindrical pipe 36 from the position of the shortest linear distance down to the cylinder axis of the cylindrical pipe 36 from the nozzles that form row A. Namely, at the position in question, the head 31 forcibly ejects ink downward from the nozzles that form row A. Because of this, as compared with the case of the first example of operation, ink drops ejected from the nozzles land on a more steeply sloped face, and therefore it is possible for the ink drops that land on the curved face of the cylindrical pipe 36 to flow more easily.

As depicted in FIG. 4A, the head 31 according to the present embodiment carries out flushing at an offset in a direction away from the fans 81 in the orthogonal direction in question. This can reduce the extent to which air blown from the fans 81 is directed onto the area on the cylindrical pipe 36 where ink drops land and onto the area where the landed ink drops flow away. Because of this, drying out of the ink in the areas in question can be prevented, and therefore ink that lands on the curved face of the cylindrical pipe 36 can flow easily downward.

The ink drops ejected from the nozzles in this way land on the curved face, which is the sloped face of the cylindrical pipe 36, and thereafter proceed to flow away downward along the curved face, ultimately dripping off from the cylindrical pipe 36. The dripped ink drops are received by the flushing box 37 and held inside.

Next, as depicted in FIG. 4B, the head 31, which is continuing to travel, now carries out flushing for the nozzle row of row B, at a position that is offset in a direction orthogonal to the cylinder axis direction of the cylindrical pipe 36 from the position of the shortest linear distance down to the cylinder axis of the cylindrical pipe 36 from the nozzles that form row B. Namely, at the position in question, the head 31 forcibly ejects ink downward from the nozzles that form row B. In so doing, it is possible for ink drops that land on the curved face of the cylindrical pipe 36 to flow more easily.

As depicted in FIG. 4B, the present embodiment involves an offset of the head in a direction away from the fans 81 in the orthogonal direction in question. Because of this, drying of ink is prevented, and ink that has landed on the curved face of the cylindrical pipe 36 can flow easily downward.

The ink drops that have been ejected from the nozzles in this way land on the curved face, which is the sloped face of the cylindrical pipe 36, and thereafter proceed to flow away downward along the curved face and drip off from the cylindrical pipe 36. The dripped ink drops are received by the flushing box 37 and held inside.

In this way, with the liquid ejection device 1 in the present embodiment, for either nozzle row, flushing takes place at a position offset from the position of the shortest linear distance, whereby ink drops that land on the curved face of the cylindrical pipe 36 can flow more easily. Also, because flushing takes place at a position offset in a direction away from the fans 81, drying out of the ink drops that land on the curved face of the cylindrical pipe 36 can be prevented, and the ink drops that land on the curved face in question can flow more easily.

Meanwhile, in cases where the amount of ink that lands on the curved face of the cylindrical pipe 36 is small, the ink dries before it can flow and becomes deposited on the curved face, and the ink that has landed on the curved face can no longer flow away downward. In contrast to this, with the liquid ejection device in the present embodiment, when flushing of every nozzle row is carried out, flushing takes place at the same area of the cylindrical pipe 36 for either nozzle row, and therefore even in cases where the amount of ink ejected onto the area in question from every nozzle row is small, adding up the amounts of ink for all of the nozzle rows increases the amount of ink that lands on the area in question. Because of this, ink that lands on the curved face of the cylindrical pipe 36 can easily flow away downward without drying.

Other Embodiments

While the present embodiment has primarily set forth a liquid ejection device, the present Specification also includes disclosure of a liquid ejection method and the like. The present embodiment is intended to facilitate understanding the present invention and should not be construed as limiting the present invention. Modifications and improvements to the present invention may be contemplated without departing from the spirit thereof, and such equivalents will naturally be included within the scope of the present invention. In particular, the embodiments mentioned hereinbelow are included within the scope of the present invention.

First Liquid-Receiving Section

In the preceding embodiment, the first liquid-receiving section was described taking the example of a cylindrical pipe 36, but no limitation thereto is imposed. For example, no limitation is imposed to a receiving member having a circular cross-sectional shape such as the cylindrical pipe 36, and receiving members having cross-sectional shapes such as semicircular shapes, fan shapes, elliptical shapes, triangular shapes, or the like are acceptable as well.

Surface Treatment

The first liquid-receiving section in the preceding embodiment may be given hydrophilic treatment. Hydrophilic treatment is a surface treatment for coating a surface with a substance having hydrophilicity, such as titanium oxide or the like.

Figure 5:
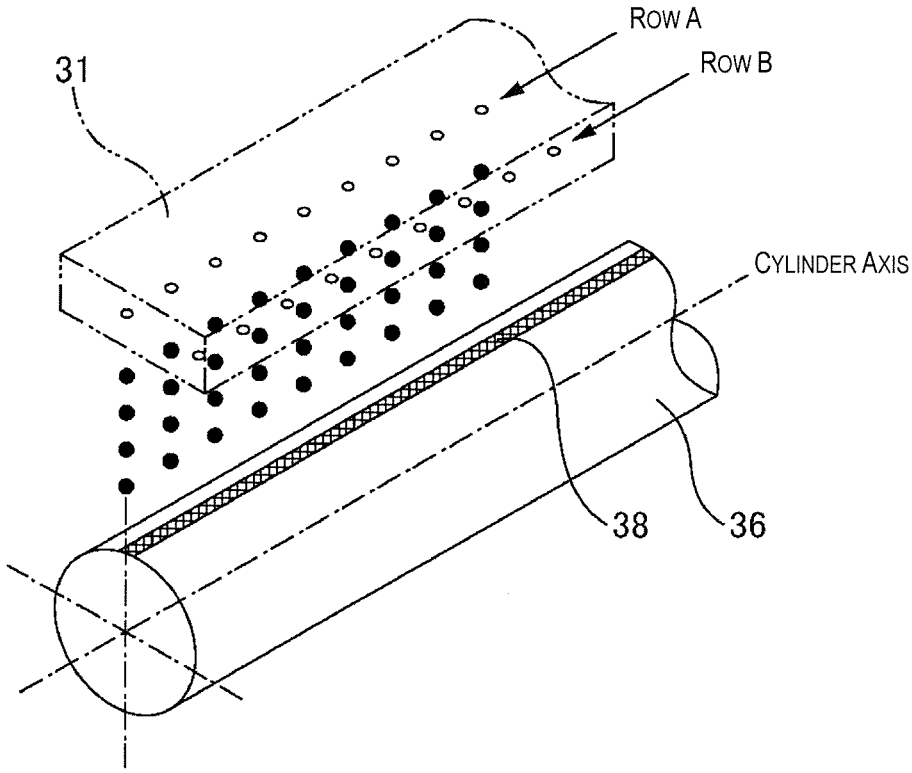
FIG. 5 is a diagram depicting a cylindrical pipe 36, part of which has undergone surface treatment.

Surface treatment of the cylindrical pipe 36 is described using FIG. 5. FIG. 5 is a diagram depicting the cylindrical pipe 36 having undergone hydrophilic treatment. For convenience, description is made using a head 31 having on its bottom face two nozzle rows (row A, row B) formed by a plurality of nozzles that are lined up along the cylinder axis direction of the cylindrical pipe 36, the two nozzle rows (row A, row B) being lined up in a direction orthogonal to the cylinder axis direction.

As depicted in FIG. 5, the cylindrical pipe 36 has an outer layer section 38 composed of a substance having hydrophilicity (e.g., titanium oxide) on part of the curved face. Namely, the outer layer section 38 is furnished along the landing area of ink drops ejected from the nozzles that form the nozzle rows.

As depicted in FIG. 5, when the head 31 ejects ink drops downward from the nozzles that form the nozzle row of row A, the ejected ink drops all land on the outer layer section 38 of the cylindrical pipe 36 (the same is true in the case of row B). Because the outer layer section 38 has hydrophilicity, the ink drops that have landed spread out in a limited range where the outer layer section 38 is present. Thereupon, because the range of spread is limited, the ink layer is thicker in that range only (ink collects in this range only), and the ink easily flows downward.

While it is possible to furnish the outer layer section 38 to the entirety of the curved face of the cylindrical pipe 36, owing to the hydrophilicity of the outer layer section 38, the ink drops that land thereon would spread out over the entirety of the curved face, and therefore the ink layer would become thinner. While the landed ink would still flow away downward along the curved face of the cylindrical pipe 36, in some cases, it might dry out prior to dripping into the flushing box 37. Consequently, it is preferable to furnish the outer layer section 38 to only a part of the curved face of the cylindrical pipe 36.

Liquid Ejection Device

Whereas in the preceding embodiments, the liquid ejection device is described taking the example of an inkjet printer, no limitation to this is imposed. For example, liquid ejection devices that eject liquids besides ink are also acceptable. Adaptation is also possible in liquid ejection devices of various types provided with a liquid ejection head or the like for ejecting minutely small drops. The term "drop" refers to the state in which a liquid is ejected from the liquid ejection device, and includes granular shape, teardrop shape, or filiform shape having a tail. Herein, the term "liquid" refers to any material that can be ejected from a liquid ejection device. For example, any state when a substance is in the liquid phase is acceptable, including not only liquid bodies of high or low viscosity, sols, gel water, or other fluid bodies such as inorganic solvents, organic solvents, solutions, liquid resins, and liquid metals (molten metals), and liquids containing a single state of a substance, but including also materials in which particles of functional materials composed of solids such as pigments, metal powders, or the like are dissolved, dispersed, or admixed into a medium. Ink, such as described in the preceding embodiments, or liquid crystals, may also be cited as typical examples of liquids. Here, the term "ink" is used in a sense inclusive of ordinary water-based inks and oil-based inks, as well as various types of liquid compositions such as gel inks, hot-melt inks, and the like. Specific examples of liquid ejection devices include liquid ejection devices for ejecting liquids that contain materials such as electrode materials or coloring matter in dispersed or dissolved form, used for manufacturing, for example, liquid crystal displays, electroluminescence (EL) displays, surface emitting displays, color filters, and the like; liquid ejection devices for ejecting bioorganic compounds for use in biochip manufacture; liquid ejection devices for ejecting liquid specimens and used as precision pipettes; textile printing devices; microdispensers; and the like. Further, liquid ejection devices for pinpoint ejection of lubricants into precision instruments such as clocks or cameras; liquid ejection devices adapted to eject ultraviolet-curing resin or other such transparent resin solutions onto substrates for the purpose of forming very small semi-spherical lenses (optical lenses) for use in optical communication elements or the like; or liquid ejection devices adapted to eject acid, alkali, or other etchant solutions for etching substrates and the like may be adopted as well. The present invention may be implemented in any one of these types of liquid ejection device.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a head having a plurality of nozzles configured and arranged to eject a liquid;

a first liquid-receiving section having a sloped face for receiving a liquid ejected from the nozzles when flushing is carried out by the head, the first liquid-receiving section having a cylindrical shape, and configured and arranged to receive the liquid ejected downward from the nozzles on a curving face of the cylindrical shape, which constitutes the sloped face; and a second liquid-receiving section configured and arranged to receive and hold liquid that has dripped from the sloped face, the nozzles forming at least one nozzle row extending in a direction along a cylinder axis direction of the first liquid-receiving section.

2. The liquid ejection device according to claim 1, wherein the at least one nozzle row includes a plurality of nozzle rows lined up in a direction orthogonal to the cylinder axis direction of the first liquid-receiving section, each of the nozzle rows extending along the cylinder axis direction, and when flushing of one of the nozzle rows is carried out, the head is configured and arranged to eject the liquid downward from the nozzles of the one of the nozzle rows with the one of the nozzle rows being at a position at which a distance from the nozzles that form the one of the nozzle rows to the cylinder axis of the first liquid-receiving section is the shortest.

3. The liquid ejection device according to claim 1, wherein the at least one nozzle row includes a plurality of nozzle rows lined up in a direction orthogonal to the cylinder axis direction of the first liquid-receiving section, each of the nozzle rows extending along the cylinder axis direction, and when flushing of one of the nozzle rows is carried out, the head is configured and arranged to eject the liquid downward from the nozzles of the one of the nozzle rows with the one of the nozzle rows being at a position that is offset in the direction orthogonal to the cylinder axis direction from a position at which a distance from the nozzles that form the one of the nozzle rows to the cylinder axis of the first liquid-receiving section is the shortest.

4. The liquid ejection device according to claim 3, further comprising a conveying section configured and arranged to convey a medium along a conveyance path, and a blower disposed above a printing region on the conveyance path, and configured and arranged to blow air onto the medium on the conveyance path, the head being configured and arranged to eject the liquid downward from the nozzles of the one of the nozzle rows at a position that is offset in a direction away from the blower in the direction orthogonal to the cylinder axis direction from the position at which the distance from the nozzles that form the one of the nozzle rows to the cylinder axis of the first liquid-receiving section is the shortest.

5. The liquid ejection device according to claim 1, wherein at least a part of the sloped face of the first liquid-receiving section has an outer layer section of a substance having hydrophilicity.

6. A liquid ejection method for a liquid ejection device including a head having a plurality of nozzles forming at least one nozzle row configured and arranged to eject a liquid, a first liquid-receiving section having a cylindrical shape with a curving face for receiving a liquid ejected downward from the nozzles when flushing is carried out by the head, and a second liquid-receiving section configured and arranged to receive and hold liquid that has dripped from the sloped face, the liquid ejection method comprising:

placing the at least one nozzle row with respect to the first liquid-receiving section so that the at least one nozzle row extends in a direction along a cylinder axis direction of the first liquid-receiving section; and ejecting the liquid from the nozzles to the curving face of the first liquid-receiving section to carry out the flushing so that the liquid that has dripped from the curving face is received and held in the second liquid-receiving section.

* * * * *